US007578716B2

(12) United States Patent
Hagedorn

(10) Patent No.: US 7,578,716 B2
(45) Date of Patent: Aug. 25, 2009

(54) AQUATIC FLOAT

(76) Inventor: Larry S. Hagedorn, 1826 Rockford Ct., Allen, TX (US) 75013

( * ) Notice: Subject to any disclaimer, the term of this patent is extended or adjusted under 35 U.S.C. 154(b) by 15 days.

(21) Appl. No.: 11/735,545

(22) Filed: Apr. 16, 2007

(65) Prior Publication Data

US 2008/0081526 A1 Apr. 3, 2008

Related U.S. Application Data

(60) Provisional application No. 60/827,756, filed on Oct. 2, 2006.

(51) Int. Cl.
*B63C 9/08* (2006.01)

(52) U.S. Cl. ..... 441/129

(58) Field of Classification Search ..... 441/35, 441/129, 130, 131, 132; 482/55, 111
See application file for complete search history.

(56) References Cited

U.S. PATENT DOCUMENTS 4,006,503 A * 2/1977 Wood ..... 441/129
4,138,753 A * 2/1979 Wood ..... 441/129
4,451,240 A * 5/1984 Wood ..... 441/129
5,090,695 A * 2/1992 Ciolino ..... 441/129
5,562,514 A * 10/1996 Rowe ..... 441/130
5,685,753 A * 11/1997 Canela et al. ..... 441/129
5,725,404 A * 3/1998 Gomez ..... 441/130
6,475,048 B2 * 11/2002 Gredy ..... 441/129
6,887,186 B2 * 5/2005 Bambanian ..... 441/129

* cited by examiner

*Primary Examiner*—Lars A Olson
(74) *Attorney, Agent, or Firm*—Michael A. O'Neil

(57) ABSTRACT

An aquatic float comprises a torso supporting section for supporting the torso of a person using the float, a head and neck supporting section secured at one end of the torso supporting section for supporting the head and neck of a person using the aquatic float, and a leg supporting section secured at the opposite end of the torso supporting section for supporting the legs of a person lying supine on the float and for providing additional buoyant support for the torso of a person sitting upright on the float.

1 Claim, 6 Drawing Sheets

AQUATIC FLOAT

CROSS-REFERENCE TO RELATED APPLICATION

This application claims priority based on provisional patent application Ser. No. 60/827,756 filed Oct. 2, 2006, the entire content of which is incorporated herein by reference.

TECHNICAL FIELD

This invention relates generally to aquatic floats, and more particularly to an aquatic float which facilitates sitting upright in the water.

BACKGROUND AND SUMMARY OF THE INVENTION

Aquatic floats, also known as rafts, are widely used in and around swimming pools, ponds, lakes, and at beachfront locations. Most often aquatic floats are used to support persons on the surface of the water. Aquatic floats are also used in conjunction with swimming lessons. In emergency situations aquatic floats can sometimes be employed as lifesaving devices.

Although other types are occasionally encountered, most aquatic floats comprise either a plastic foam construction or an air-filled construction. Plastic foam-type aquatic floats may be rigid, semi-rigid, or flexible in nature and are often encased in a layer of vinyl. Air-filled floats comprise one or more layers of plastic film which are heat sealed in such a way as to contain a quantity of air and thereby provide flotation. Air-filled aquatic floats are typically less durable than plastic foam aquatic floats and are often designed for one time usage.

Because they are primarily intended to support an adult person on the surface of the water most aquatic floats are typically rectangular in shape and are characterized by lengths of about five feet and widths of about two and a half feet. One difficulty that is associated with nearly all prior art aquatic floats comprises the fact that they are not configured to allow a person to sit upright in the water. For this reason the use of an aquatic float substantially negates the possibility of meaningful conversation and other activities which require sitting upright.

The present invention comprises an aquatic float which overcomes the foregoing and other difficulties which have long since characterized the prior art. In accordance with the broader aspects of the invention an aquatic float comprises a torso supporting section constructed from plastic foam material and configured to support the torso of an adult person. A head and neck supporting section having a cylindrical configuration is provided at one end of the torso supporting section for supporting the head and neck of a user of the float. The opposite end of the float comprises a leg supporting section including a longitudinal portion extending from the end of the torso supporting section remote from the head and neck supporting section and a transverse portion located adjacent the distal end of the longitudinal portion. The leg supporting section of the plastic float supports the legs of the user when the user is being supported in a horizontal orientation by the plastic float. When the user desires to sit upright in the water, his or her legs are oriented between the torso supporting section and the transverse portion of the leg supporting section of the plastic float whereupon the aquatic float automatically configures itself to support the head and neck of the user while providing sufficient buoyancy to support the torso of the user in the conventional sitting orientation.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
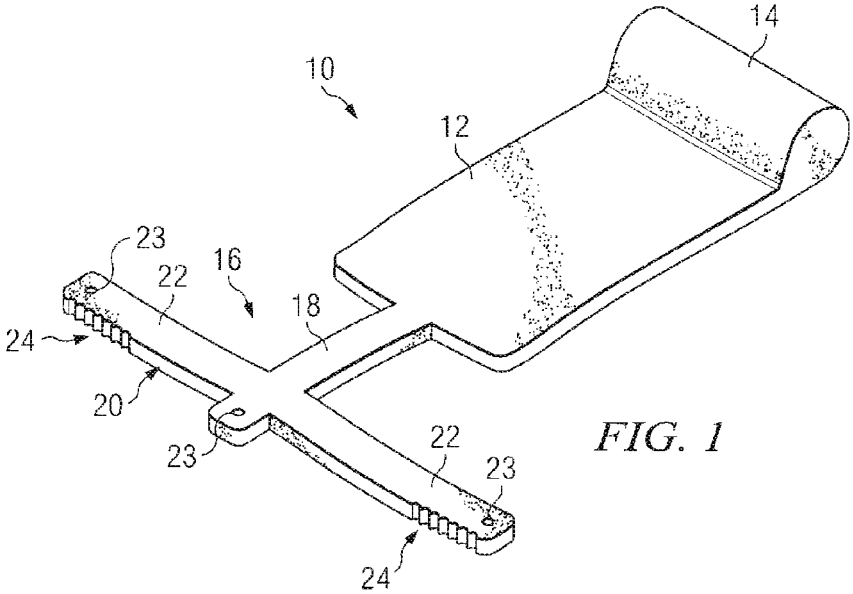
FIG. 1 is a perspective view of an aquatic float comprising a first embodiment of the invention.

Referring now to the drawings and particularly to FIG. 1 thereof, there is shown an aquatic float 10 comprising a first embodiment of the invention. The aquatic float 10 includes a torso supporting section 12 which receives and supports the torso of the user of the aquatic float 10. The torso supporting section 12 and the remaining components of the aquatic float 10 are formed from a plastic foam material which is substantially flexible in nature. As will be understood by those skilled in the art, the torso supporting section 12 and the remaining components of the aquatic float 10 may be covered with a vinyl layer, if desired.

A head and neck supporting section 14 is secured to one end of the torso supporting section 12 of the aquatic float 10. The head and neck supporting section 14 may be manufactured by rolling the material utilized in the construction of the torso supporting section 12 into a tubular configuration and then securing the rolled plastic foam material in place either by means of a suitable adhesive or by means of welding. Alternatively, the head and neck supporting section 14 may comprise an integral cylindrical construction which is secured to the torso supporting section 12 of the aquatic float 10 by means of a suitable adhesive or by welding. If the head and neck supporting section 14 is constructed separately from the torso supporting section 12 it may be manufactured from the same plastic foam material utilized in the manufacture of the torso supporting section 12 or from a different plastic foam material depending upon the requirements of the particular applications of the invention.

Figure 6:
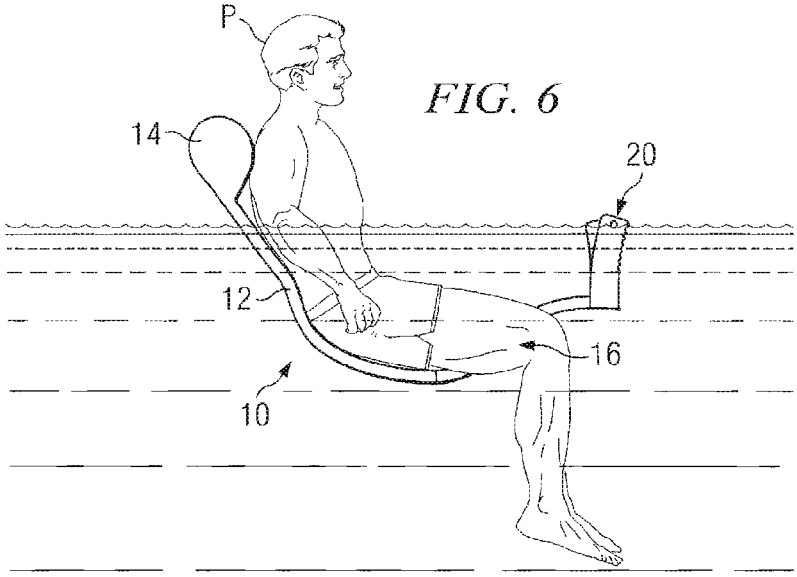
FIG. 6 is an illustration of a third utilization of the aquatic float comprising the present invention.

The aquatic float 10 further comprises a leg supporting section 16 which is secured to the end of the torso supporting section 12 remote from the head and neck supporting section 14. The leg supporting section 16 comprises a longitudinal portion 18 which extends along the center line of the aquatic float 10 and a transverse portion 20 comprising arms 22 extending outwardly in opposite directions from the longitudinal portion 18. The longitudinal portion 18 and arms 22 of the leg supporting section 16 may incorporate holes 23 so as to allow the aquatic float 10 to be tied or otherwise attached to boats, anchors, ladders, floating trays, other aquatic floats, etc. Further, the arms 22 of the leg supporting section 16 may be provided with finger receiving grooves 24 for use in manipulating the aquatic float 10 when a person P is seated thereon as illustrated in FIG. 6.

The component parts of the leg supporting section 16 of the aquatic float 10 may be formed from the same plastic foam material that is used in the construction of the torso supporting section 12 or from a different plastic foam material depending upon the requirements of particular applications of the invention. Although illustrated as being rectangular in cross section, the component parts of the leg supporting section 16 may also be cylindrical in cross section.

Figure 3:
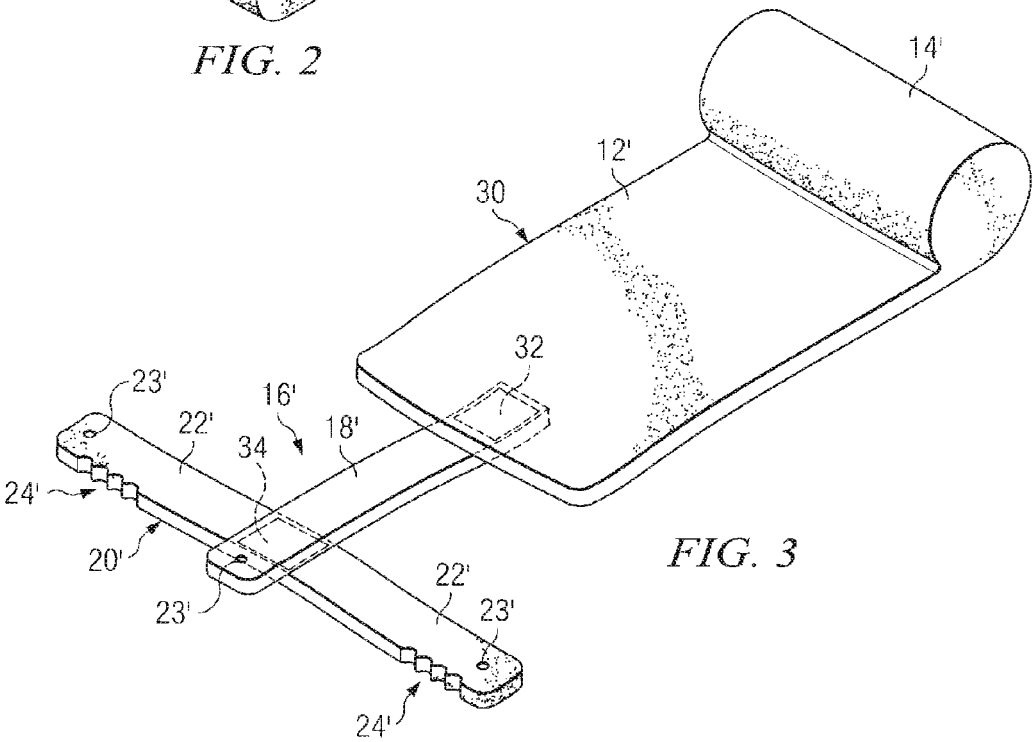
FIG. 3 is a perspective view illustrating an aquatic float comprising a second embodiment of the invention.

An aquatic float 30 comprising a second embodiment of the invention is illustrated in FIG. 3. Many of the component parts of the aquatic float 30 are substantially identical in construction and function to the component parts of the aquatic float 10 illustrated in FIG. 1 and described above in conjunction therewith. Such identical component parts are designated in FIG. 3 with the same reference numerals utilized above in the description of the aquatic float 10 but are differentiated therefrom by means of a prime (') designation.

The aquatic float 30 differs from the aquatic float 10 in that the longitudinal portion 18' of the leg supporting section 16' is detachably secured to the torso supporting section 12' of the aquatic float 30 by means of a suitable fastener 32. The fastener 32 utilized to secure the longitudinal portion 18' to the torso supporting section 12' may comprise hook-and-loop type fasteners, snap-type fasteners, or any of the well known fastener configurations utilized for interconnecting plastic components. Similarly, the transverse portion 20' of the leg supporting section 16' is secured to the longitudinally extending portion 18' thereof a fastener 34. Like the fastener 32 the fastener 34 may comprise hook-and-loop type fasteners, snap-type fasteners, or any of the other well known fastener configurations utilized in the joining of plastic components. As will be appreciated by those skilled in the art, the longitudinal portion 18' may be detachably secured to the top of the torso supporting section 12' and/or the transverse portion 20' may be detachably secured to the top of the longitudinal portion 18', if desired.

Figure 2:
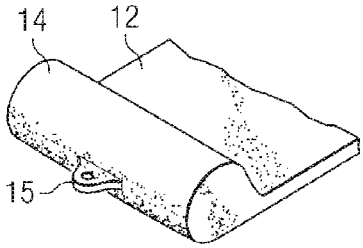
FIG. 2 is a perspective view illustrating a portion of an aquatic float comprising the invention.

As shown in FIG. 2, the head and neck supporting section 14 and 14' of FIGS. 1 and 3 respectively may also be configured with a grommet 15 so as to allow the aquatic floats 10 and 30 to be tied or otherwise attached to boats, anchors, ladders, floating trays, other aquatic floats, etc. The grommet 15 may be formed from the same plastic foam material that is used in the construction of the head and neck supporting section 14 or 14', from a different plastic foam material, or from metal, plastic, etc. depending upon the requirements of the particular applications of the invention. A separate grommet 15 may be secured in place on the head and neck supporting section 14 or 14' either by means of a suitable adhesive or by means of welding. Alternatively, the grommet 15 may comprise an integral construction with the head and neck supporting section 14 or 14'.

Figure 7:
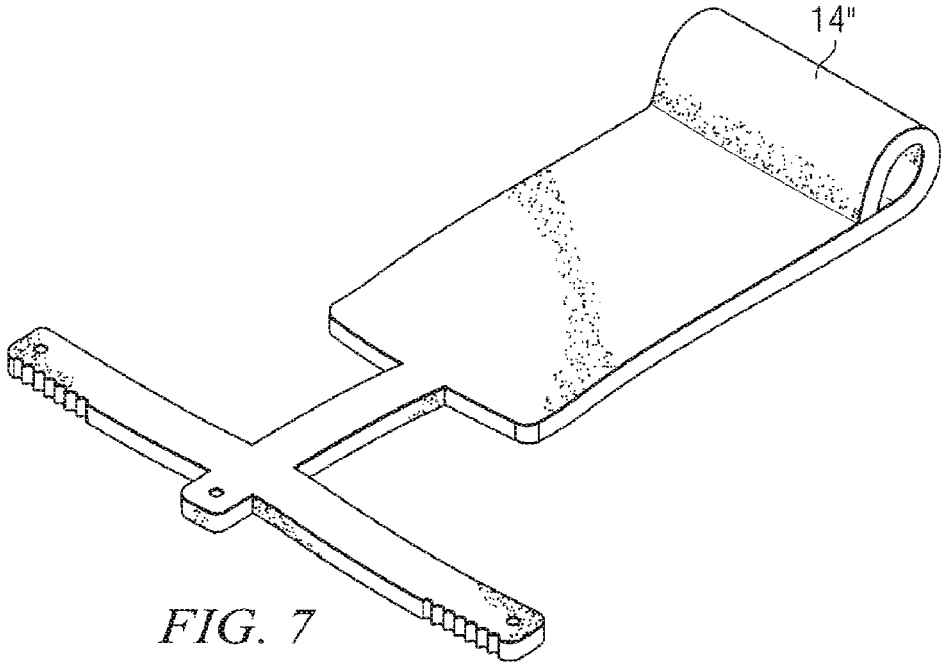
FIG. 7 is a perspective view illustrating an aquatic float comprising a third embodiment of the invention.

The head and neck supporting sections 14 and 14' of FIGS. 1 and 2 respectively may be either solid, or hollow, as shown by the head and neck supporting section 14" of FIG. 7. The hollow head and neck supporting section 14" is constructed in similar fashion to the solid head and neck supporting sections 14 and 14' as shown in FIGS. 1 and 3 respectively.

Figure 4:
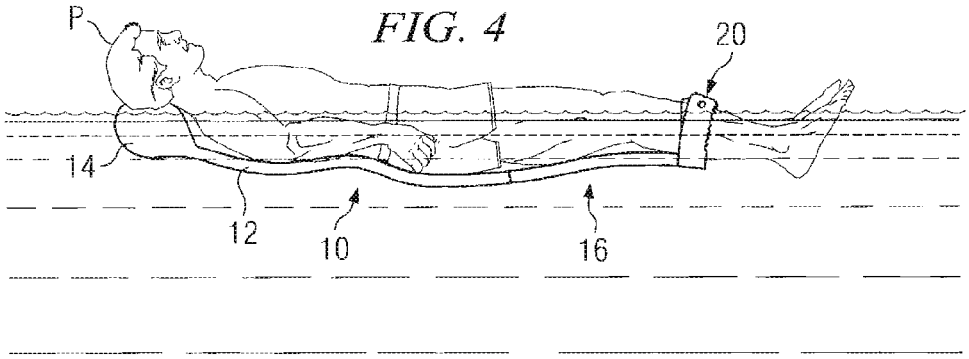
FIG. 4 is an illustration of a first utilization of an aquatic float comprising the present invention.
Figure 5:
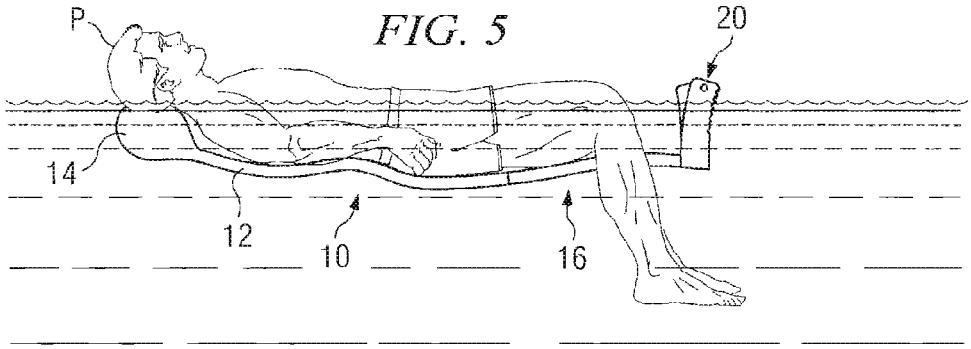
FIG. 5 is an illustration of a second utilization of the aquatic float comprising the present invention.

Utilization of the aquatic float 10 comprising the present invention is illustrated in FIGS. 4, 5, and 6. FIG. 4 illustrates a person P lying supine on the aquatic float 10 with the head of the person P supported on the head and neck supporting section 14 of the aquatic float 10, with the torso of the person P supported on the torso supporting section 12 of the aquatic float 10, and with the legs of the person P supported on the transverse portion 20 of the leg supporting section 16 of the aquatic float 10.

FIG. 5 also illustrates the person P resting supine on the aquatic float 10. FIG. 5 differs from FIG. 4 in that the legs of the person P are bent downwardly at the knees and are therefore not supported on the transverse portion 20 of the leg supporting section 16.

FIG. 6 illustrates the person P sitting upright on the aquatic float 10. The head and neck of the person P are supported by the head and neck supporting section 14, the torso of the person P is supported by the torso supporting section 12, and the legs of the person P are bent downwardly at the knees. The buoyancy provided by the component parts of the leg supporting section 16 provides additional support for the torso of the person P when utilizing the aquatic float 10 in the manner illustrated in FIG. 6.

FIGS. 4, 5, and 6 illustrate the aquatic float 10 with the head and neck supporting section 14 thereof facing upwardly, that is, out of the water. The aquatic float 10 and the aquatic float 30 can also be utilized in an inverted orientation wherein the head and neck supporting section 14 thereof faces downwardly, that is, into the water.

In addition to conventional recreational uses, aquatic floats incorporating the present invention can be utilized for rehabilitation uses. For example, when the person P is in the sitting orientation illustrated in FIG. 6, the person P may use his or her arms to achieve either forward or rearward motion in the water. In this manner the upper arm and shoulder muscles of the person P can be effectively rehabilitated and strengthened. The sitting position illustrated in FIG. 6 also allows the person P to strengthen and rehabilitate his or her leg, thigh, knee, and ankle muscles by repetitively moving his or her legs upwardly and downwardly in the water in a manner similar to pedaling a bicycle. The present invention further provides therapy for older and disabled persons who require exercise but are not able to support themselves unless they are suspended in the water by utilization of the aquatic float of the present invention as illustrated in FIG. 6.

Figure 8:
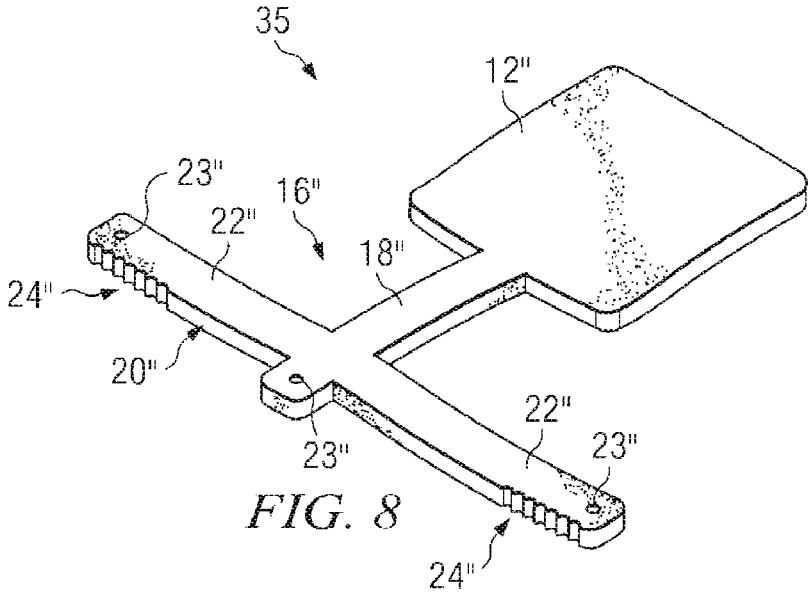
FIG. 8 is a perspective view illustrating an aquatic float comprising a fourth embodiment of the invention.

An aquatic float 35 comprising a third embodiment of the invention is illustrated in FIG. 8. Many of the component parts of the aquatic float 35 are substantially identical in construction and function to the component parts of the aquatic float 10 illustrated in FIG. 1 and described above in conjunction therewith. Such identical component parts are designated in FIG. 8 with the same reference numerals utilized above in the description of the aquatic float 10 but are differentiated therefrom by means of a double prime (") designation.

The aquatic float 35 differs from the aquatic float 10 in that it lacks the head and neck supporting section 14. Further, the torso supporting section 12" is proportionally smaller than the torso supporting section 12. In accordance with the embodiment shown in FIG. 8, a user of the aquatic float 35 straddles the longitudinal portion 18" of the leg supporting section 16" which extends along the center line of the aquatic float 35. The longitudinal portion 18" of the leg supporting section 16" thereby functions as a seat and the torso supporting section 12" functions as a seat so as to support a user in an essentially upright position in the water. The buoyancy provided by the arms 22" of the transverse portion 20" provides additional support for the torso of the person P when utilizing the aquatic float 35. Further, the arms 22" of the transverse portion 20" can also be utilized by a user to steer the aquatic float 35.

Figure 9A:
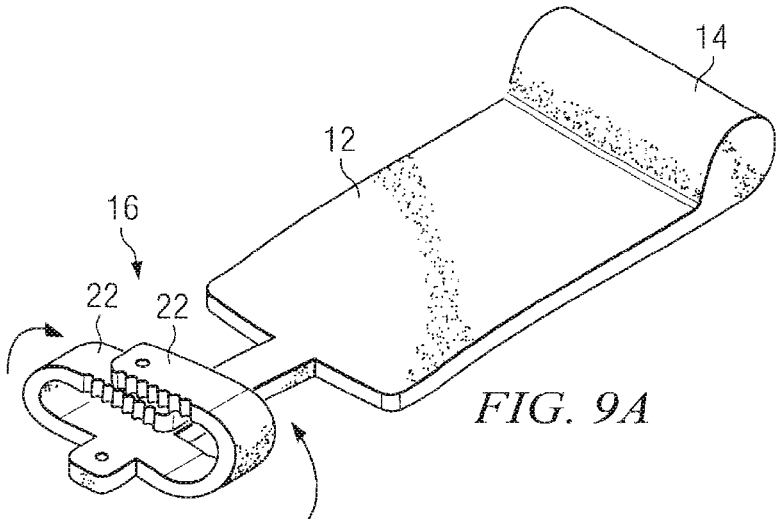
FIGS. 9A through 9C, inclusive, illustrate steps for folding and rolling an aquatic float comprising the invention.
Figure 9B:
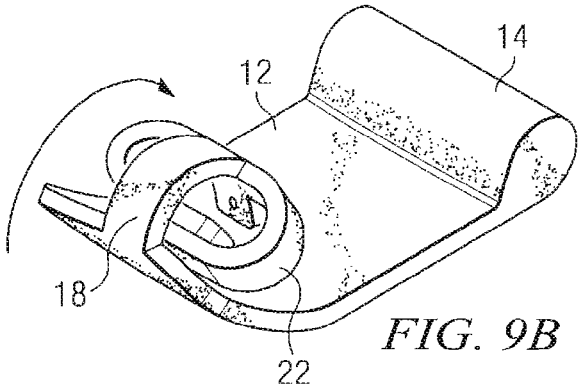
Figure 9C:
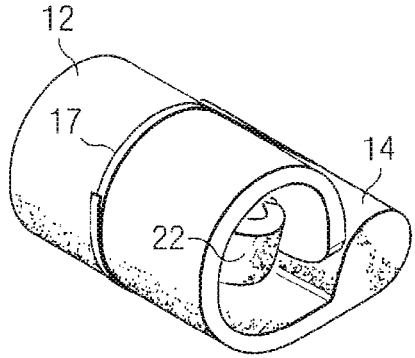
Figure 10A:
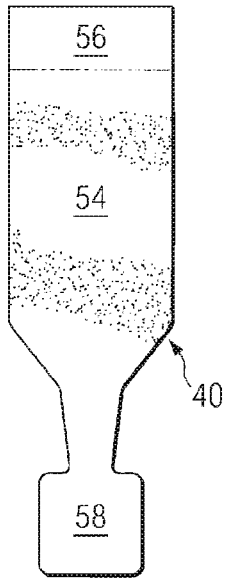
FIGS. 10A through 10K, inclusive, illustrate additional embodiments of the invention.
Figure 10B:
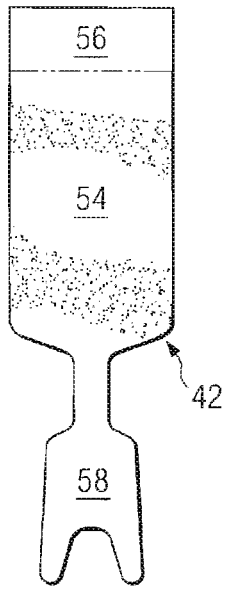
Figure 10C:
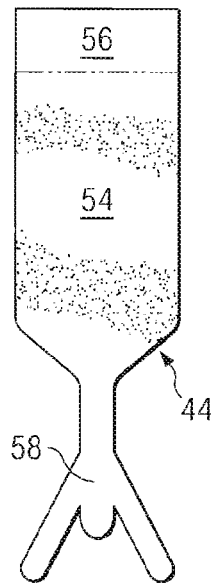
Figure 10D:
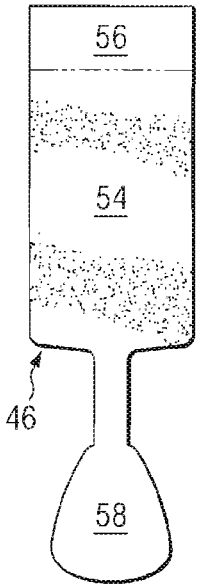
Figure 10E:
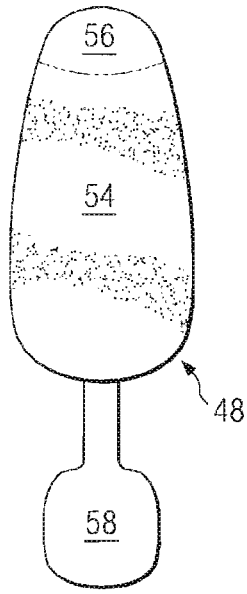
Figure 10F:
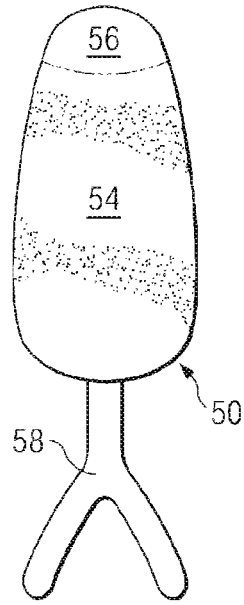
Figure 10G:
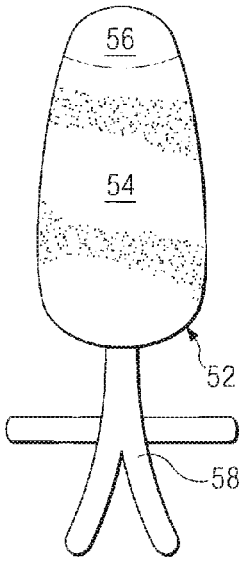
Figure 10H:
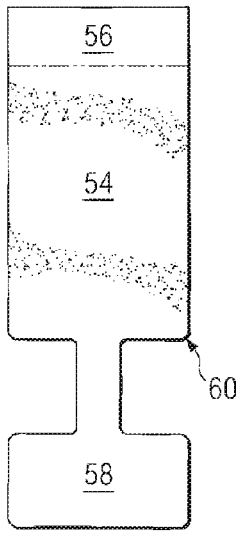
Figure 10I:
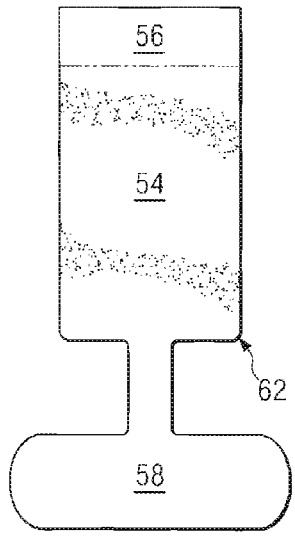
Figure 10J:
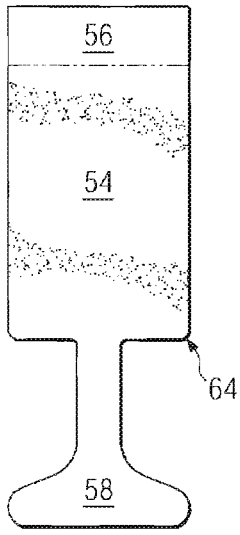
Figure 10K:
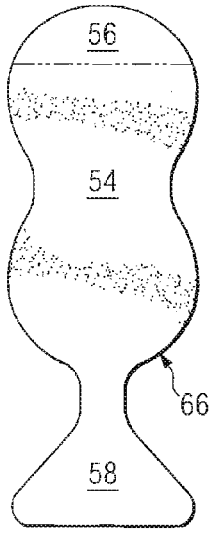

FIGS. 9A through 9C illustrate a series of steps for folding and rolling an aquatic float of the present invention so as to allow for storage and transportation of the aquatic float. In the first step as shown in FIG. 9A, the arms 22 of the leg supporting section 16 are folded inward, one on top of the other. In the second step as shown in FIG. 9B, the longitudinal portion 18 of the leg supporting section 16 is folded over and on top of the torso supporting section 12 while keeping the arms 22 of the leg supporting section 16 in the folded position. The leg supporting section 16 and torso supporting section 12 are then rolled towards the head and neck supporting section 14 of the aquatic float so as to roll the aquatic float into the configuration shown in FIG. 9C. The rolled aquatic float is then secured with a means for preventing unrolling, such as a strap 17. The aquatic floats shown in both FIGS. 1 and 3 can be folded in this fashion.

FIGS. 10A through 10K illustrate aquatic float configurations 40, 42, 44, 46, 48, 50, 52, 60, 62, 64, and 66 each comprising an additional embodiment of the present invention. Each of the aquatic float configurations 40 through 66, inclusive, comprises a torso supporting section 54, a head and neck supporting section 56, and a leg supporting section 58.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A method of folding and rolling an aquatic float comprising at least a torso supporting section and a leg supporting section further comprising a longitudinal member extending from an end of the torso supporting section and a transverse portion extending laterally outwardly from both sides of the longitudinal portion at a point adjacent the distal end of the longitudinal portion comprising the steps of:

folding opposite ends of the transverse portion of the leg supporting section inward, one on top of the other;

folding the longitudinal member of the leg supporting section over and on top of the torso supporting section so as to hold the folded transverse portion of the leg supporting section in place against the torso supporting section;

rolling the torso supporting section and leg supporting section towards the opposite end of the torso supporting section so as to roll the leg supporting section up inside of the torso supporting section; and securing the folded and rolled aquatic float utilizing a securing means so as to prevent unrolling of the aquatic float.

* * * * *